US008776452B1

(12) United States Patent
DeJonge

(10) Patent No.: US 8,776,452 B1
(45) Date of Patent: Jul. 15, 2014

(54) UNIVERSAL QUICK CORNER FOR RAISED FLOOR SYSTEM

(71) Applicant: Opstock, Inc., Grand Rapids, MI (US)

(72) Inventor: Mark O. DeJonge, Ada, MI (US)

(73) Assignee: Opstock, Inc., Grand Rapids, MI (US)

( * ) Notice: Subject to any disclaimer, the term of this patent is extended or adjusted under 35 U.S.C. 154(b) by 0 days.

(21) Appl. No.: 13/798,787

(22) Filed: Mar. 13, 2013

Related U.S. Application Data

(60) Provisional application No. 61/620,680, filed on Apr. 5, 2012.

(51) Int. Cl.
*E04B 2/82* (2006.01)

(52) U.S. Cl.
USPC ..... 52/126.1; 52/126.4; 52/220.1; 52/263

(58) Field of Classification Search
CPC ..... E04F 15/02188; E04F 15/02405; E04F 15/0247; E04F 15/024; E04F 2015/02127
USPC ..... 52/126.1, 126.4, 220.1, 263
See application file for complete search history.

(56) References Cited

U.S. PATENT DOCUMENTS

| | | | | |
|---|---|---|---|---|
| 2,781,703 | A | 2/1957 | Nagin | |
| 2,792,985 | A | 5/1957 | Heiman | |
| 3,153,553 | A | 10/1964 | Sandor | |
| 3,236,018 | A | 2/1966 | Graham et al. | |
| 3,255,687 | A | 6/1966 | Glaser | |
| 3,511,011 | A | 5/1970 | Morgan, Jr. | |
| 4,085,557 | A * | 4/1978 | Tharp | 52/263 |
| 4,258,516 | A | 3/1981 | Mori et al. | |
| 4,268,077 | A | 5/1981 | Bohleen et al. | |
| 4,277,923 | A * | 7/1981 | Rebentisch et al. | 52/126.6 |
| 4,319,520 | A | 3/1982 | Lanting et al. | |
| 4,329,939 | A | 5/1982 | Christie et al. | |
| 4,348,841 | A | 9/1982 | Ueno et al. | |
| 4,399,741 | A | 8/1983 | Zboralski | |
| 4,558,544 | A | 12/1985 | Albrecht et al. | |
| 4,593,499 | A | 6/1986 | Kobayashi et al. | |
| 4,606,156 | A | 8/1986 | Sweers et al. | |
| 4,676,036 | A | 6/1987 | Bessert | |

(Continued)

OTHER PUBLICATIONS www.triad-usfloors.com, Pages from website of Triad Access Floors Company.

(Continued)

*Primary Examiner* — Basil Katcheves
*Assistant Examiner* — Joshua Ihezie
(74) *Attorney, Agent, or Firm* — Price Heneveld LLP

(57) ABSTRACT

A floor panel assembly (used as replacement floor panel or in a new installation) includes universal quick-attach corners that mates with support stands and stringers of an existing raised floor system to provide leveling. The panel assembly includes a top plate (apertured or not) with corner structures including a post retainer and interconnected down flanges that support the top plate inboard of its perimeter. In one form, the universal quick corners each includes an arrow-shaped extension plate attached to the post retainer and extending toward the top plate's perimeter, and includes a body with multiple thickness pads selectable to support the extension plate at selected height. Thus, the quick corner holds an upper surface of the top plate level with an upper surface of adjacent existing floor panels of the existing raised floor system. In another aspect, only the body is used at each corner (without the extension plate).

21 Claims, 8 Drawing Sheets

(56) References Cited

U.S. PATENT DOCUMENTS

| | | | | | |
|---|---|---|---|---|---|
| 4,719,727 | A | * | 1/1988 | Cooper et al. | 52/126.6 |
| 4,729,292 | A | | 3/1988 | Marton | |
| 4,729,859 | A | * | 3/1988 | Munsey et al. | 264/71 |
| 4,736,555 | A | | 4/1988 | Nagare et al. | |
| 4,745,715 | A | | 5/1988 | Hardwicke et al. | |
| 4,825,603 | A | | 5/1989 | Hardwicke et al. | |
| 4,856,256 | A | | 8/1989 | Tokuzo | |
| D303,619 | S | | 9/1989 | Russell et al. | |
| D306,350 | S | | 2/1990 | Hardwicke et al. | |
| 4,901,490 | A | | 2/1990 | Zinniel et al. | |
| 4,914,881 | A | | 4/1990 | Spork | |
| 4,922,670 | A | * | 5/1990 | Naka et al. | 52/126.6 |
| 4,924,760 | A | | 5/1990 | Jobson | |
| 4,953,501 | A | | 9/1990 | Moreau | |
| 4,996,804 | A | | 3/1991 | Naka et al. | |
| 5,049,700 | A | * | 9/1991 | Kobayashi et al. | 174/482 |
| 5,052,156 | A | | 10/1991 | Tanaka et al. | |
| 5,072,557 | A | * | 12/1991 | Naka et al. | 52/126.6 |
| D325,434 | S | | 4/1992 | Dosmann | |
| D349,774 | S | | 8/1994 | Kongsgaard | |
| D350,613 | S | | 9/1994 | Fahy, Jr. | |
| 5,386,670 | A | | 2/1995 | Takeda et al. | |
| 5,389,737 | A | * | 2/1995 | Kobayashi et al. | 174/483 |
| 5,402,617 | A | | 4/1995 | Daw et al. | |
| D360,700 | S | | 7/1995 | Myers et al. | |
| 5,459,968 | A | * | 10/1995 | Jin | 52/126.6 |
| 5,477,649 | A | * | 12/1995 | Bessert | 52/263 |
| 5,628,157 | A | | 5/1997 | Chen | |
| 5,713,168 | A | | 2/1998 | Schilham | |
| D395,713 | S | | 6/1998 | Schrotenboer | |
| D397,457 | S | | 8/1998 | Hutchings | |
| 5,791,096 | A | * | 8/1998 | Chen | 52/126.6 |
| D422,061 | S | | 3/2000 | Lee | |
| 6,101,768 | A | * | 8/2000 | Springstead et al. | 52/126.6 |
| D433,165 | S | | 10/2000 | Moreau et al. | |
| 6,256,952 | B1 | | 7/2001 | Fahy, Jr. et al. | |
| 6,370,831 | B1 | | 4/2002 | Marshall et al. | |
| 6,442,906 | B1 | * | 9/2002 | Hwang | 52/126.6 |
| D465,400 | S | | 11/2002 | Moore et al. | |
| 6,519,902 | B1 | * | 2/2003 | Scissom | 52/126.4 |
| 6,550,195 | B1 | | 4/2003 | Cooper et al. | |
| 6,604,330 | B2 | * | 8/2003 | Repasky | 52/263 |
| 6,637,161 | B1 | | 10/2003 | Buchalter et al. | |
| 6,748,707 | B1 | | 6/2004 | Buchalter et al. | |
| 6,840,555 | B1 | | 1/2005 | Thompson | |
| 6,918,217 | B2 | | 7/2005 | Jakob-Bamberg et al. | |
| 6,983,570 | B2 | * | 1/2006 | Mead | 52/263 |
| 7,052,053 | B2 | | 5/2006 | Hall et al. | |
| 7,066,111 | B2 | * | 6/2006 | McGregor | 119/509 |
| D530,835 | S | | 10/2006 | Rosine et al. | |
| 7,360,343 | B1 | * | 4/2008 | Spransy et al. | 52/263 |
| 7,586,036 | B2 | * | 9/2009 | Davis et al. | 174/40 CC |
| 7,644,550 | B2 | * | 1/2010 | Meyer | 52/263 |
| 8,099,912 | B2 | * | 1/2012 | DeJonge et al. | 52/126.2 |
| 2002/0144477 | A1 | * | 10/2002 | Chen | 52/263 |
| 2004/0074170 | A1 | * | 4/2004 | Huang | 52/220.1 |
| 2005/0050818 | A1 | | 3/2005 | Chen et al. | |
| 2005/0166483 | A1 | * | 8/2005 | Mead | 52/126.7 |
| 2005/0193660 | A1 | | 9/2005 | Mead | |
| 2005/0235589 | A1 | | 10/2005 | Jakob-Bamberg et al. | |
| 2006/0248814 | A1 | | 11/2006 | Chen et al. | |
| 2007/0175132 | A1 | * | 8/2007 | Spransy et al. | 52/263 |
| 2007/0204539 | A1 | * | 9/2007 | Owen | 52/263 |
| 2008/0274685 | A1 | * | 11/2008 | DeJonge et al. | 454/241 |
| 2010/0000163 | A1 | * | 1/2010 | Tsai et al. | 52/126.6 |
| 2010/0205874 | A1 | * | 8/2010 | Zlatar | 52/126.6 |

OTHER PUBLICATIONS

ASM Modular Floors Catalog, Innovations in Access Flooring.
cTec Access Flooring Systems, CTec, Inc.
Computer Environments, Inc., Brochure.
PATI, Raised Access Floor System Brochure.
Aspmaxcess, Global Leaders in Intelligent Office Solutions, Raised Floor Guide.
Architectural Solutions, Pathways Floors & Wiring—Steelcase.
InterfaceAR, Product Profile: TecSteel Access Flooring.
InterfaceAR: Atlantic Access Floors.
Access Floors Product Guide: Access Floors to the Power of Tate.
InterfaceAR, Product Profile: TEcCrete Access Flooring.

* cited by examiner

UNIVERSAL QUICK CORNER FOR RAISED FLOOR SYSTEM

This application claims benefit under 35 USC §119(e) of provisional Application No. 61/620,680 filed Apr. 5, 2012, entitled UNIVERSAL QUICK CORNER FOR RAISED FLOOR SYSTEMS, the entire contents of which are incorporated herein.

BACKGROUND

The present invention relates to a raised floor panel for a raised floor system such as for a data center (computer room), the floor panels being adapted to mate with various existing raised floor systems either as a new or retrofit installation.

Raised floor systems include support stands for supporting floor panels above a building's structural floor, with a top of each support stand typically supporting the mating corners of four adjacent floor panels to create a raised floor over the building's structural floor. This allows flexible installation and distribution of cabling and wires, and also allows air conditioning to be funneled under the raised floor and into the room through apertured panels (also called "air grates") at selected strategic locations in the room. However, raised floor systems provided by different vendors are not standardized. Therefore, replacement panels must be purchased from the original manufacturer of the raised floor system, or a replacement panel with customized corners must be made, since the corners of the replacement panel must matingly stably engage the configured top of the support stand in the existing raised floor system. Improvements are desired to allow replacement floor panels (including air-passing air grates) to mate with a wide variety of support stands of different existing raised floor panel systems, yet without the need for customized corners. Alternatively, improvements are desired that allow corners of replacement floor panels (including air grates) to be easily customized without numerous specialized parts and expensive components.

SUMMARY OF THE PRESENT INVENTION

In one aspect of the present invention, a floor panel assembly is provided for use in an existing raised floor system, where the existing raised floor system includes existing floor panels with existing support stands and existing stringers connected between the existing support stands for supporting floor panels. The floor panel assembly comprises a floor panel with a top and corner structures, each corner structure including a first retainer and down flanges that support the top inward from a perimeter of the top, and a universal quick corner at each corner structure. Each universal quick corner includes an extension plate attached to the first retainer and extending outboard of the down flanges at least partially toward the perimeter, and includes a body with at least one thickness pad supporting the extension plate so that the extension plate engages one or both of the associated stringer and support stand to hold an upper surface of the top level with an upper surface of existing floor panels of the raised floor system.

In a narrower form, the first retainer includes a post retainer.

In a narrower form, the body includes four pads of different thicknesses, the body being selectively engaged with the associated extension plate to support the top at a level condition with adjacent raised floor panels of the existing raised floor system.

In another aspect of the present invention, a method of constructing a floor panel assembly is provided for use in an existing raised floor system, where the existing raised floor system includes existing floor panels and existing support stands for supporting corners of the existing floor panels. The floor panel assembly comprises steps of: providing a floor panel with a top and corner structures, each corner structure including a post retainer and down flanges that support corners of the top inward from a perimeter of the top, and attaching a universal quick corner to each corner structure, the quick corners each having and a body with at least one thickness pad, the body engaging the associated corner structure on the floor panel and the quick corner engaging an associated portion of the existing raised floor system to hold an upper surface of the top level with an upper surface of the existing floor panels of the existing raised floor system.

In another aspect of the present invention, a floor panel assembly is provided for use in an existing raised floor system, where the existing raised floor system includes existing floor panels and existing support stands and existing stringers connected between the existing support stands for supporting the existing floor panels. An improvement in the floor panel assembly comprises a floor panel with a top and corner structures, each corner structure including a post retainer and interconnected down flanges that support corners of the top plate inward from a perimeter of the top plate. A universal quick corner at each corner structure includes a body with at least two different thickness pads. The body is selectively orientable on an associated one of the corner structures to position a selected one of the at least two different thickness pads to engage and support the floor panel on an associated portion of the existing support stand and stringer, thus holding an upper surface of the top level with an upper surface of existing floor panels on the existing raised floor system.

In another aspect of the present invention, a method of assembly in an existing raised floor system is provided, where the existing raised floor system includes existing floor panels and existing support stands and existing stringers connected between the existing support stands for supporting the existing floor panels. The method comprises steps of: providing a floor panel with a top and corner structures, each corner structure including a post retainer and interconnected down flanges that support corners of the top inward from a perimeter of the top, providing a universal quick corner at each corner structure, the universal quick corner having a body with at least two different thickness pads, and selectively orienting the body on the an associated one of the corner structures to position a selected one of the at least two different thickness pads to support an extension plate; so that the extension plate supports and engages the floor panel using the selectively oriented quick corner body and extension plate to engage an associated portion corner of the existing support stand and stringer, thus holding an upper surface of the top level with an upper surface of existing floor panels in the existing raised floor system.

An object of the present invention is to provide a very durable and robust support for the corner structures of a floor panel which extends toward, and potentially all the way to, a perimeter of its top plate, with the assembly being sufficiently robust such that over time it does not creep, wear, migrate or shift in a manner leading to uneven support of corners of the floor panel assembly.

An object of the present invention is to provide a universal quick attach corner attachable to a raised floor panel, where the quick attach corner engages a portion of the support structure in an existing raised floor panel system, and support corners of the raise floor panel in a level condition with adjacent panels of the existing raised floor system.

These and other aspects, objects, and features of the present invention will be understood and appreciated by those skilled in the art upon studying the following specification, claims, and appended drawings.

DETAILED DESCRIPTION OF PREFERRED EMBODIMENTS

Figure 1:
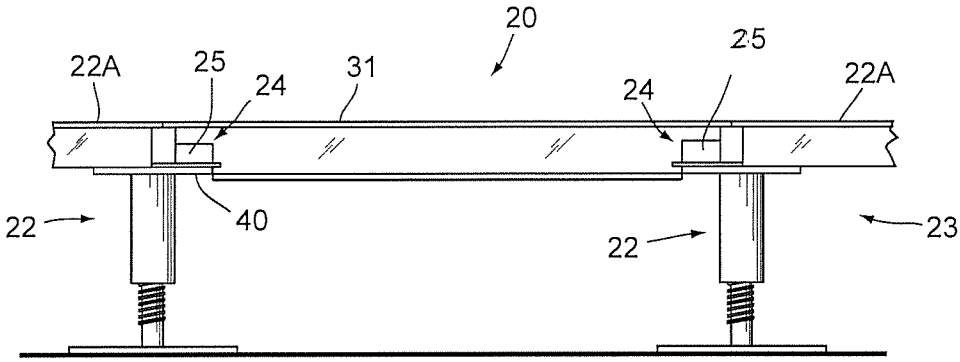
FIG. 1 is a side view of a raised floor system, including an innovative raised floor panel embodying the present invention installed onto existing support stands and installed between existing floor panels of an existing raised floor system.
Figure 2:
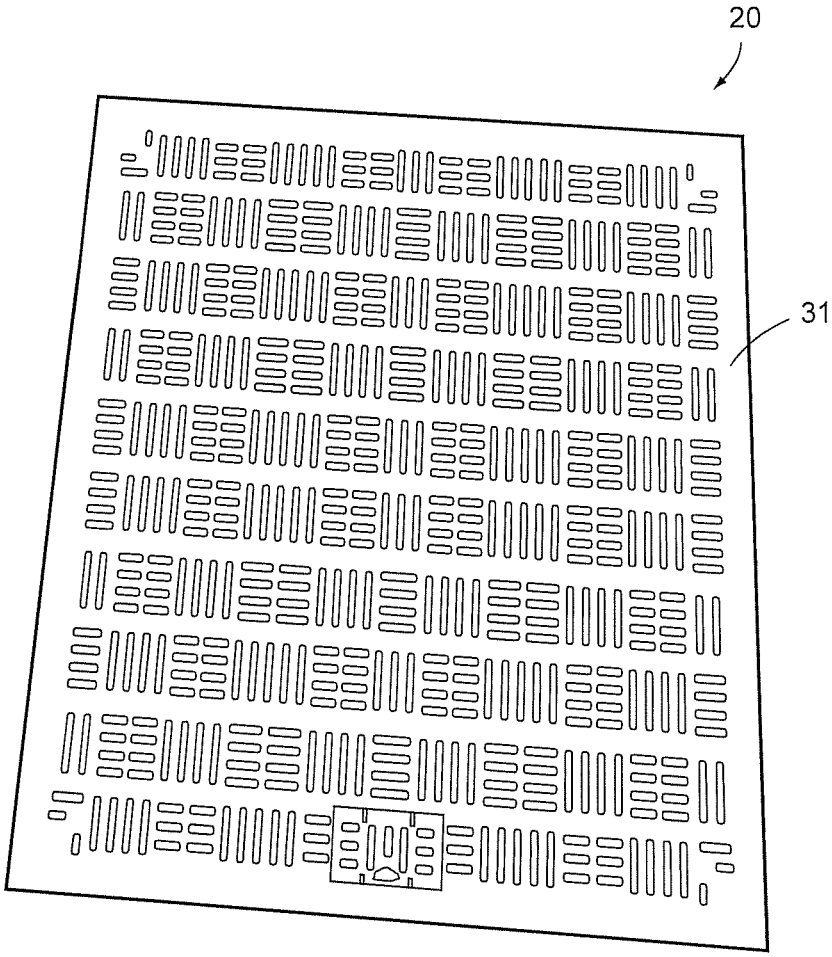
FIGS. 2-3 are top and bottom perspective views of the present innovative raised floor panel in FIG. 1, FIG. 3 showing a universal quick corner installed onto a left rear (far) corner structure of the panel and showing a left front (close) corner structure of the panel with universal quick corner disassembled and positioned adjacent the corner structure.
Figure 3:
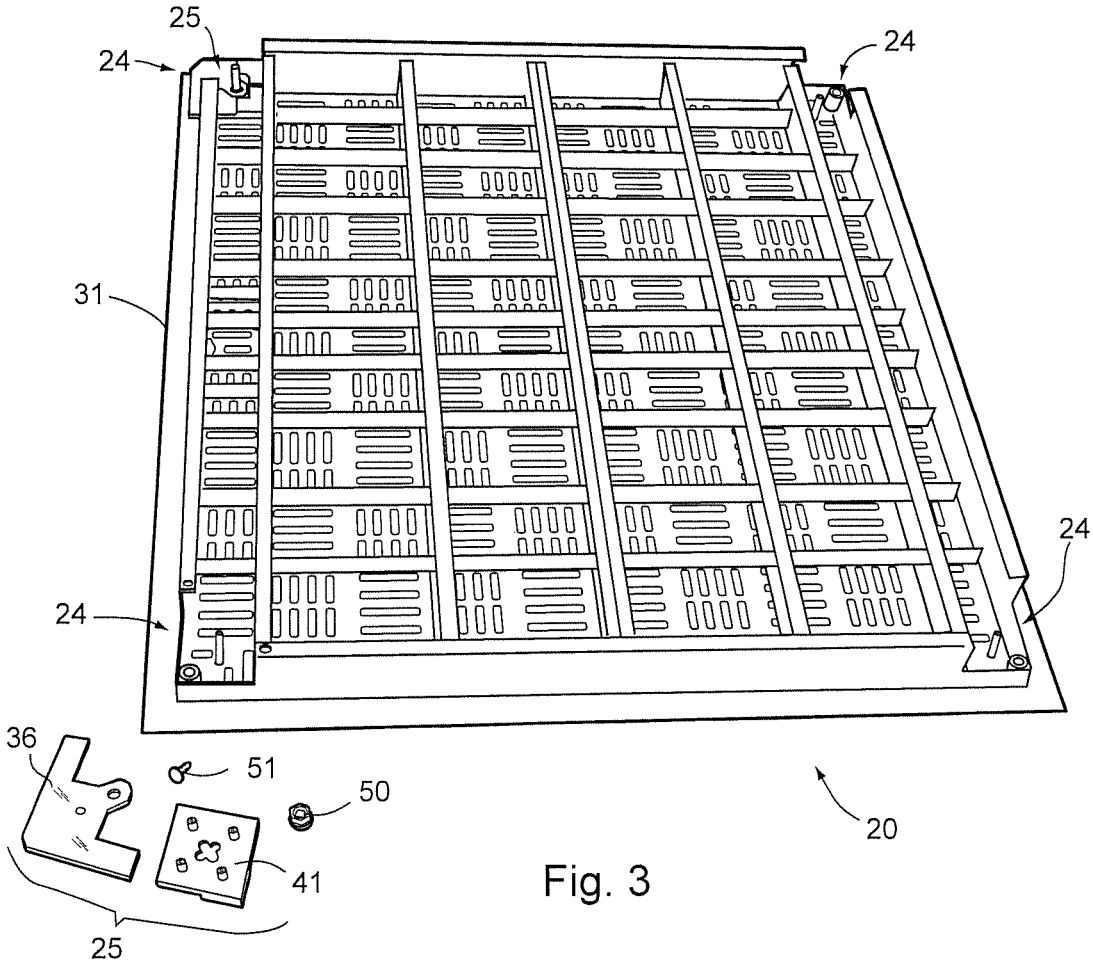

A replacement floor panel assembly 20 (FIG. 1) includes corner structures 24 that can be adapted to mate with the existing support stands 22 (and align with existing floor panels 22A) in an existing raised floor system 23. The illustrated floor panel assembly 20 is adapted to mate with various existing raised floor systems either as a new or retrofit installation. Notably, different existing raised floor systems include support stands with differently configured/shaped top members/heads, thus making it difficult to provide a single replacement floor panel assembly adapted to mate with each of those different support stands. The foot print of floor panels in most commercial raised floor panel systems is standardized, but configuration and shape of the supporting structure is not. The present assembly 20 provides a corner structure 24 and universal quick corner 25 providing the desired adaptability for a replacement floor panel assembly while maintaining manufacturability and keeping both costs and number of pieces under control for the universal floor panel assembly. As discussed below, the illustrated assembly 20 provides a very durable and robust support for the corner structures 24 which extends all the way to a perimeter of the top plate 31. Significantly, the assembly 20 as installed is sufficiently robust such that over time it does not creep, wear, migrate or shift in a manner leading to uneven support of corners of the floor panel assembly 20.

The illustrated replacement assembly 20 is a raised floor panel with top defining corners, and four corner structures 24. The illustrated top is an aperture top plate 31 permitting air pass-through (e.g. the assembly 20 is an apertured air grate permitting air pass through), but it is contemplated that it need not be apertured. The corner structures 24 include a post retainer 32, an apertured boss retainer 47, and interconnected down flanges 33, 34 that support the top plate 31 inward of its perimeter. The illustrated top plate 31 is an apertured/slotted steel panel allowing it to be used as an air grate for controlled air flow in a raised floor system. However, a scope of the present inventive concepts also extends to non-apertured raised floor panels and panels not having a top plate per se. The assembly 20 further includes a universal quick corner 25 at each corner structure 24. The universal quick corner 25 can be pre-assembled in pieces to the floor panel assembly 20 (see FIGS. 6-10, using nut retainer 50 and pin retainer 51) or can be pre-assembled (see FIG. 11, using pin retainer 51) and then attached to the floor panel 20 (using nut retainer 50).

Figure 5:
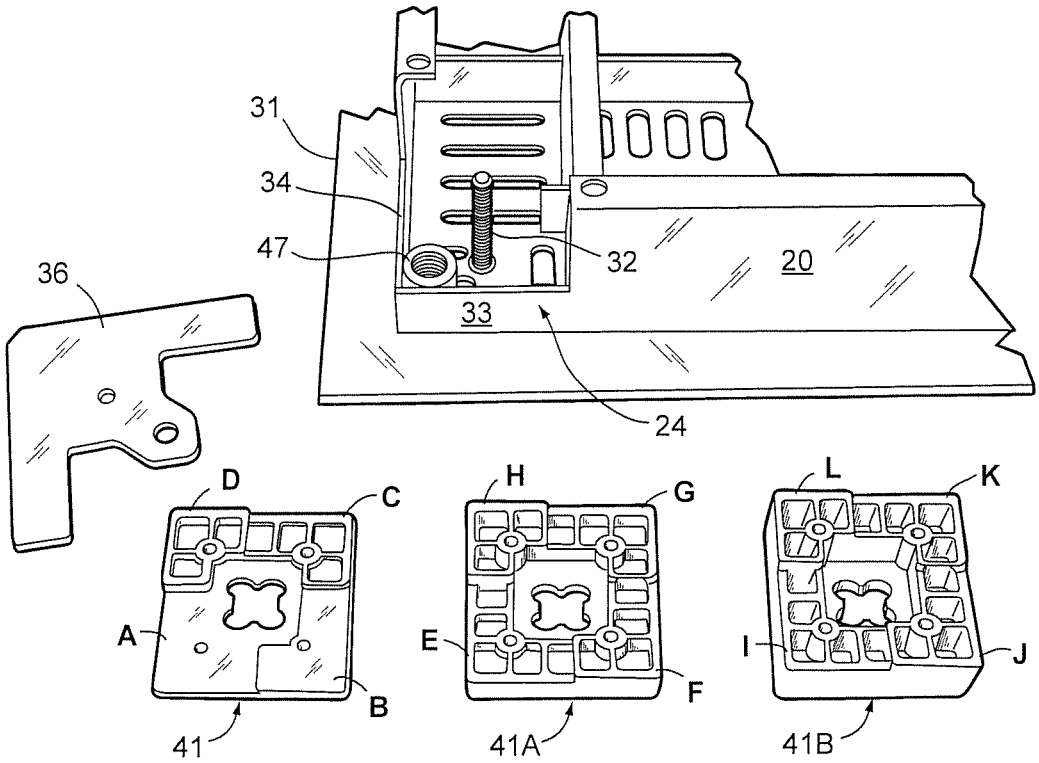
FIG. 5 is a fragmentary perspective view similar to FIG. 4 but illustrating the corner structure, the extension plate, and three multi-pad bodies each with different thickness (height) pads.
Figure 6:
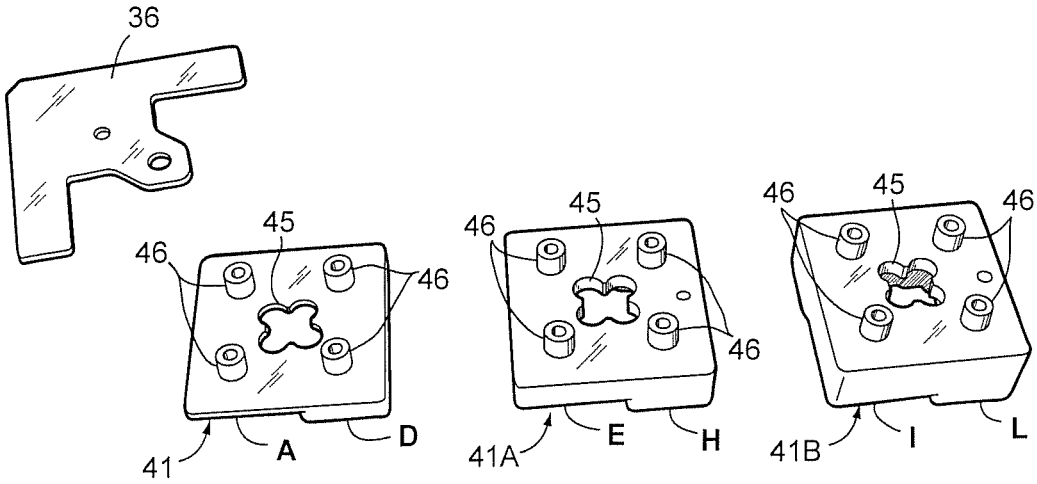
FIG. 6 is a perspective view illustrating the same multi-pad bodies as FIG. 5 but flipped upside down.
Figure 7:
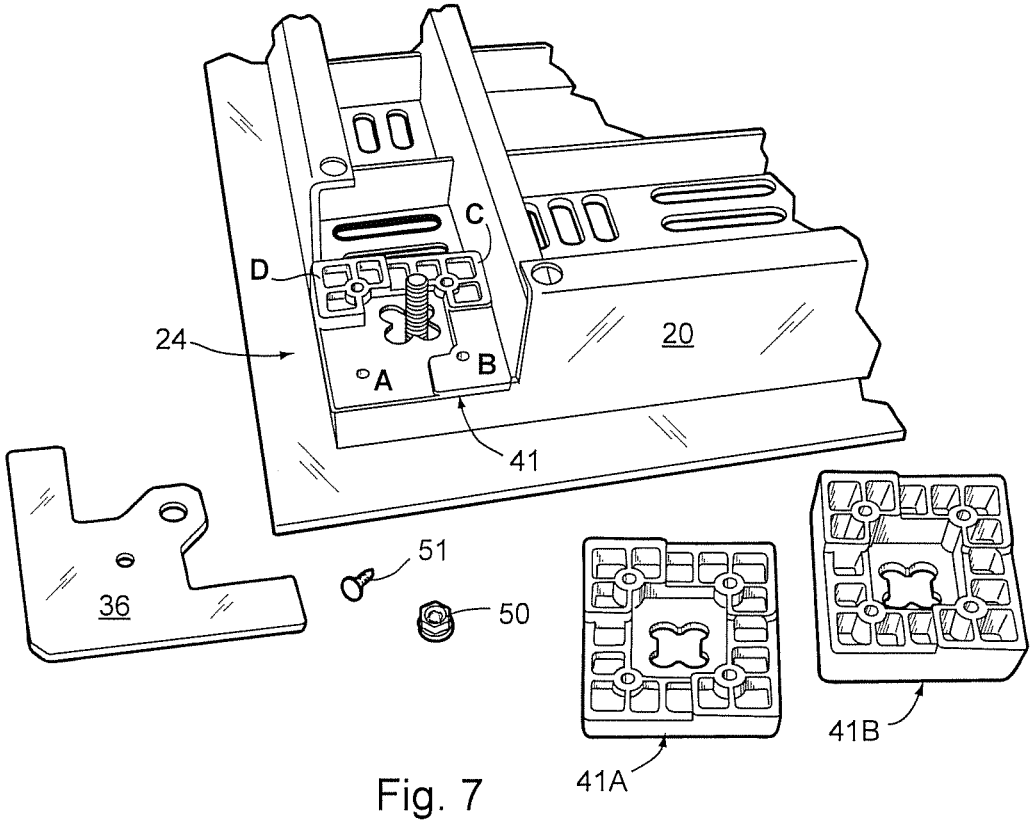
FIG. 7 is a perspective view showing the thinnest one of the bodies from FIGS. 5-6 installed with the thinnest "A" pad positioned outward toward a perimeter corner of the top of the raised floor panel, and showing a friction retainer (nut) and second friction retainer (push pin).
Figure 8:
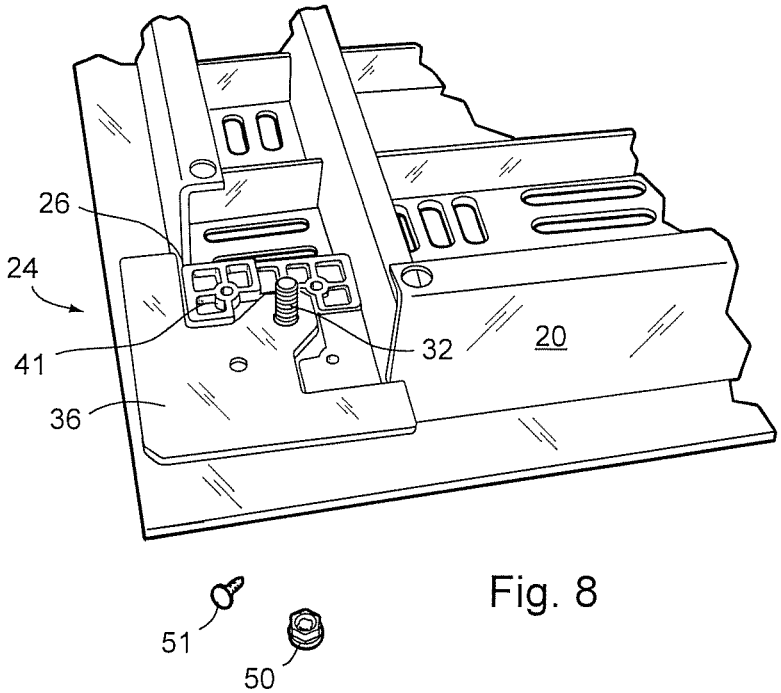
FIG. 8 is a perspective view like FIG. 7 but showing the extension plate installed on the body.
Figure 9:
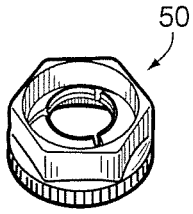
FIG. 9 is a perspective view showing a quick-install push-on-and-twist nut retainer in FIG. 7.
Figure 10:
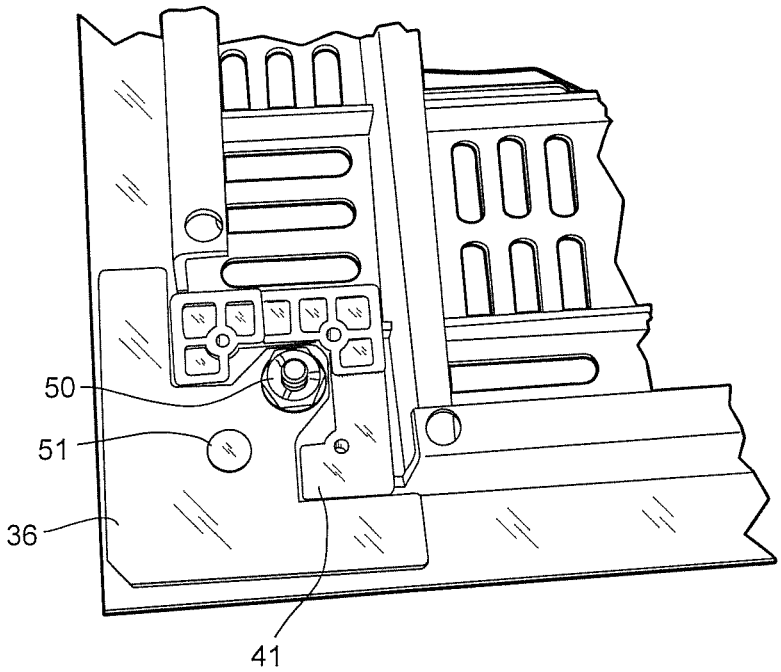
FIG. 10 is a perspective view showing the nut retainer installed, thus holding the quick corner (extension plate and body) on the corner structure of the raised floor panel.

The illustrated universal quick corner 25 (FIG. 5) includes an arrow-shaped extension plate 36 and three different universal multi-pad bodies 41, 41A, and 41B that can be selected for use with the extension plate 36 (or used without the extension plate). The bodies 41, 41A and 41B each include four different thickness pads, and they can be attached to the floor panel 20 in four different orientations. Thus, by selecting a desired body and installing it at a desired orientation, any of twelve different height positions of the extension plate 36 can be achieved (which allows the installer to select between twelve different height positions for a top surface of the raised floor panel relative to existing floor panels of the existing floor panel system). This has proved to be very beneficial and desirable in commerce, since once the existing raised floor system is known, the replacement assemblies 20 can be quickly and easily assembled (on site or ahead of time at a staging location or a location not too far from the installation site), yet without the need for fixturing, tooling, lead times, and other problems associated with such installations. It is noted that the present assembly 20 can be used in new installations, such as for providing air conditioning air grates in the new "existing" system, even though the air grate panel assemblies (20) are from a different manufacturer.

Figure 13:
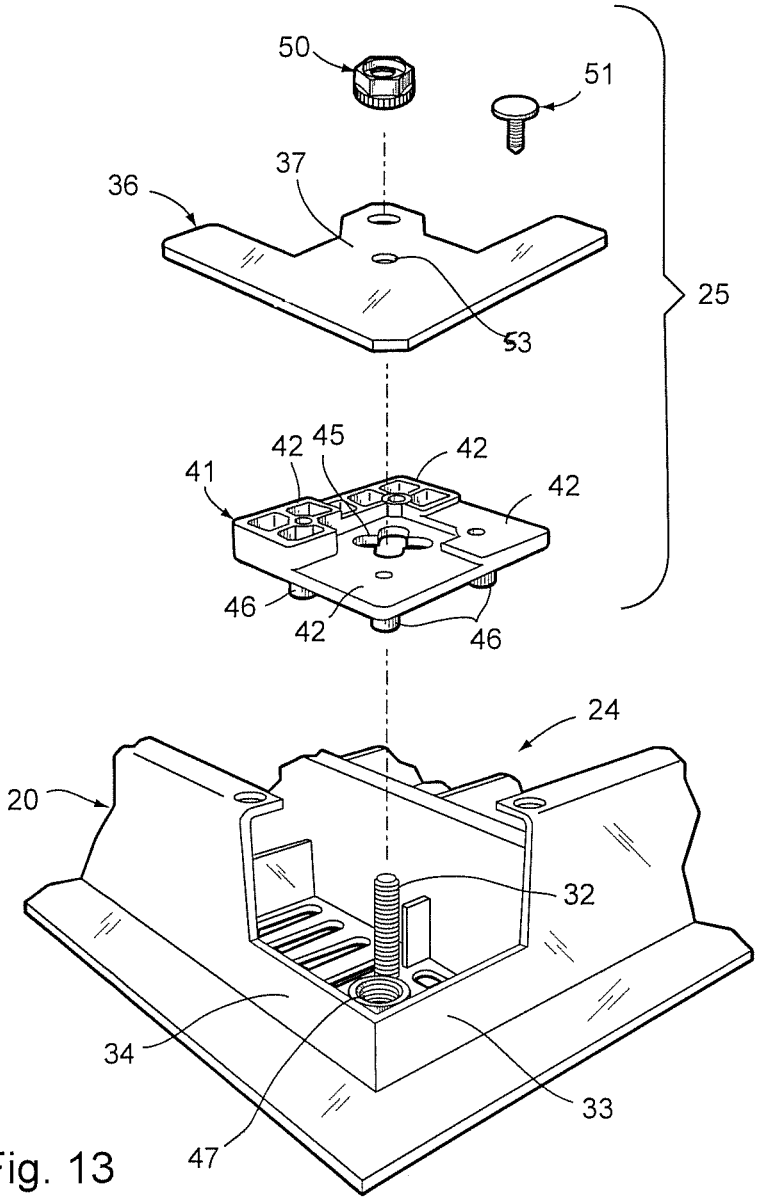
FIG. 13 is an exploded perspective view showing the components of FIG. 7 ready for assembly.

The extension plate 36 is attached to the post retainer 32 by a friction retainer, such as nut 50. The extension plate 36 is stamped from metal, such as steel plate. It includes an inner section (FIG. 13) with hole 38 for engaging the post retainer 32, and includes a V-shaped outboard section that extends outward of the down flanges 33, 34 to a position generally vertically aligned with (or close to vertical alignment with) the perimeter of the top plate 31 of the raised floor panel 30. This allows the extension plate 36 to engage any load-bearing portion of the top member 40 (FIG. 1) of the existing support stand 22, even if the load-bearing portion of the top member 40 is outboard of the down flanges 33, 34.

Figure 4:
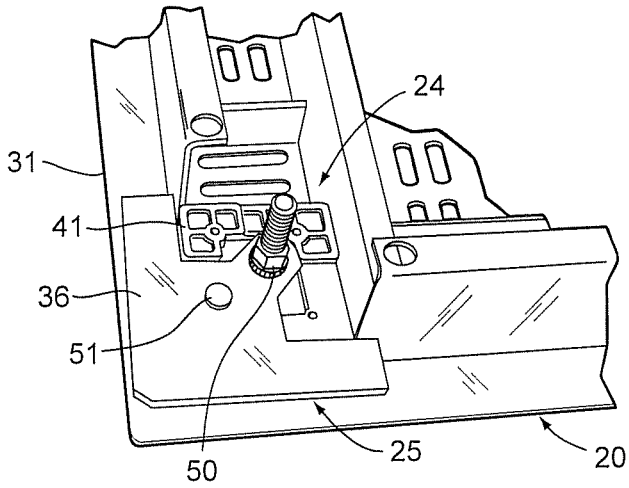
FIG. 4 is an enlarged fragmentary perspective view of a corner structure from FIG. 3 with the universal quick corner installed.
Figure 13A:
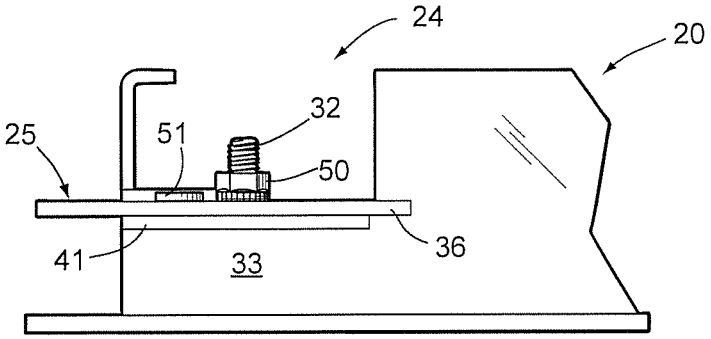
FIG. 13A is a side view of FIG. 12.
Figure 14:
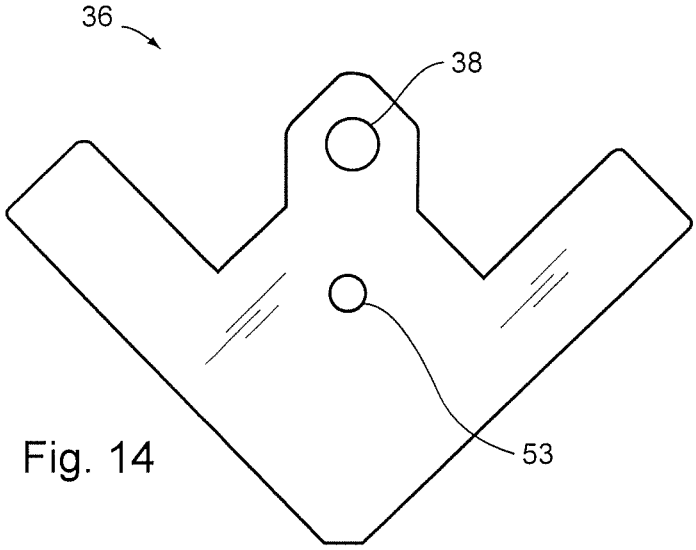
FIGS. 14-15 are plan and side views of the illustrated extension plate of FIG. 13.
Figure 15:
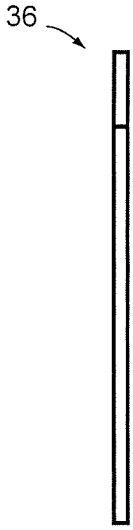
Figure 16:
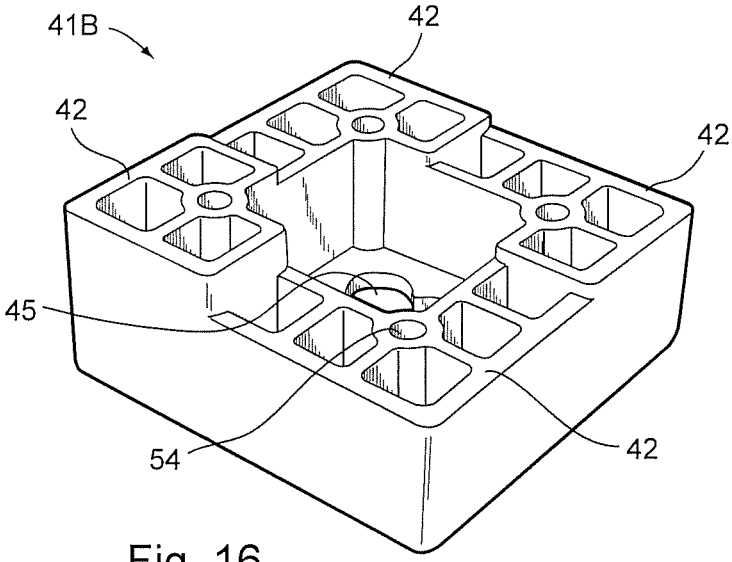
FIGS. 16-17 are bottom perspective and side views of a thickest one of the bodies in FIG. 5.
Figure 17:
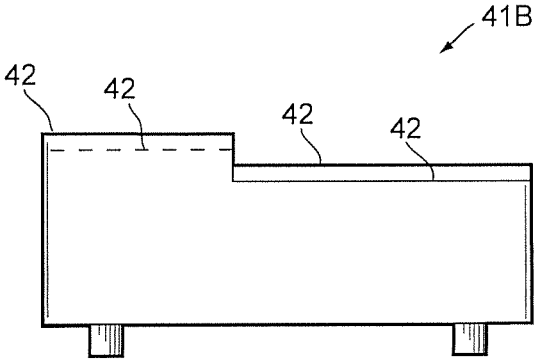

The illustrated universal quick corner 25 (FIGS. 16-17) also includes a body 41 with thickness pads 42 selectable to support the extension plate 36 (FIGS. 4, 13-13A) so that the extension plate 36 engages the associated stringers and existing corner support stand 22 (FIG. 1) to hold an upper surface of the top plate 31 level with an upper surface of existing floor panels 22A, with the quick corner 25 supporting the arrangement by engaging a portion of the one existing stringer and support stand 22. The thickness pads 42 differ in height as desired. For example, pads 42 can vary in height about 1/16", resulting in a total range of heights that can be selected of about 3/4". For example, in the illustrated system, the extension plate 36 can be positioned at anywhere from 1" to 1 11/16" from the top surface of the top plate 31.

It is noted that there are two distinct and different applications for the illustrated parts. One application uses a selected body 41 by itself to engage an existing support stand (or uses a selected body 41A or 41B). The other application uses the body 41 in combination with the extension plate 36 to engage onto a connecting stringer grid members (with each stringer grid member being bolted onto the top surface of an existing support stand and extending between adjacent support stands).

When both body 41 and extension plate 36 are assembled (FIGS. 1, 4, 13A), the selected thickness pad 42 of the body 41 is positioned so that it rests on the flanges 33, 34, and the extension plate 36 rests on the selected thickness pad 42, thus allowing stress to be transmitted directly through the assembly by compression. This provides a very durable and robust support for the corner structures 24 which extends all the way to a perimeter of the top plate 31, with the assembly being sufficiently robust such that over time it does not creep, wear, migrate or shift in a manner leading to uneven support of corners of the floor panel assembly 20.

The illustrated body 41 (see FIG. 16) is injection molded of structural polymeric material (such a nylon or glass-fiber-reinforced nylon, depending on functional requirements of the raised floor system). Each body 41, 41A, 41B includes a center plate with four pads 42 (see FIGS. 5-6, labeled as pads A, B, C, and D on one body (41), and pads E-H on body 41A and pads I-L on body 41B. A star-shaped center hole 45 includes rounded points shaped to engage the post retainer 32, depending on which pad is positioned outwardly on the corner structure 24. Protruding pins 46 are shaped to engage the apertured boss retainer 47 located outboard of the post retainer 32. This, in combination with the hole 45 engaging post retainer 32, positively holds the orientation and location of the body 41 when installed on the corners structure 24. The pads 42 can be formed to conform with optimal molding practices. For example, the illustrated pads 42 (FIG. 16) include orthogonal walls and ribs to eliminate large pockets of plastic, which if present would cause cooling problems in molded parts. Also, ribs are present within and between pads 42 as needed to support stress and to provide a more rigid and robust overall structure, while minimizing total part weight and while maintaining simplicity of molding.

The illustrated friction retainer 50 is a push-on-and-twist-lock nut shaped to resiliently slip onto the end of the post retainer 32 for quick installation. Thereafter, the nut retainer 50 can be rotated on the threads of the post 32 (also called "post retainer" herein) to provide a desired torsional compression retention force. It is contemplated that other friction retainers can be used, such as a polymeric tube or washer frictionally engaging the post retainer 32.

Figure 11:
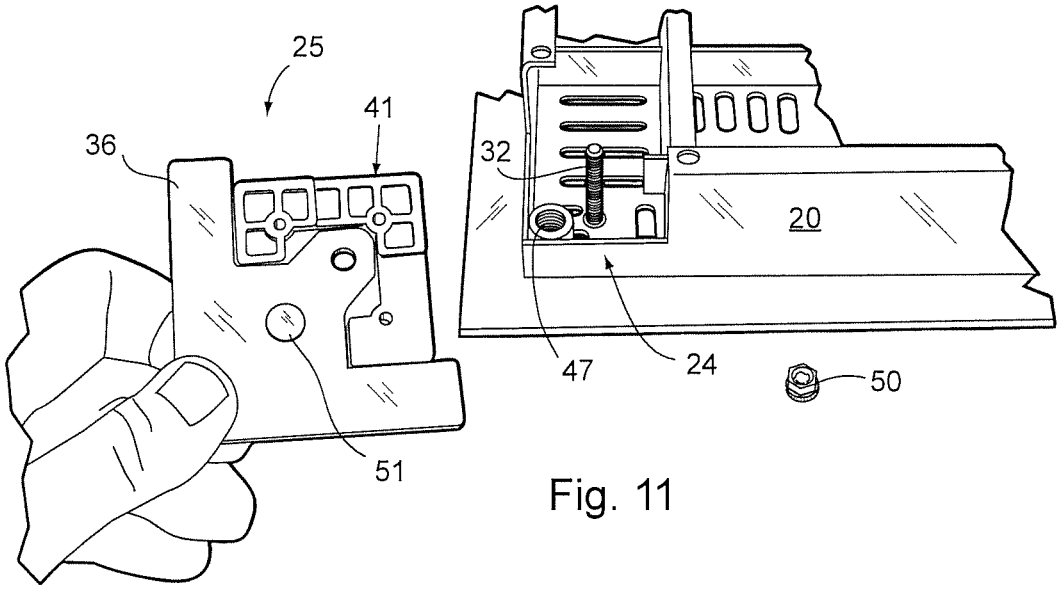
FIG. 11 is a perspective view showing the body and extension plate subassembled together by using the push pin retainer and prior to installation on a raised floor panel.
Figure 12:
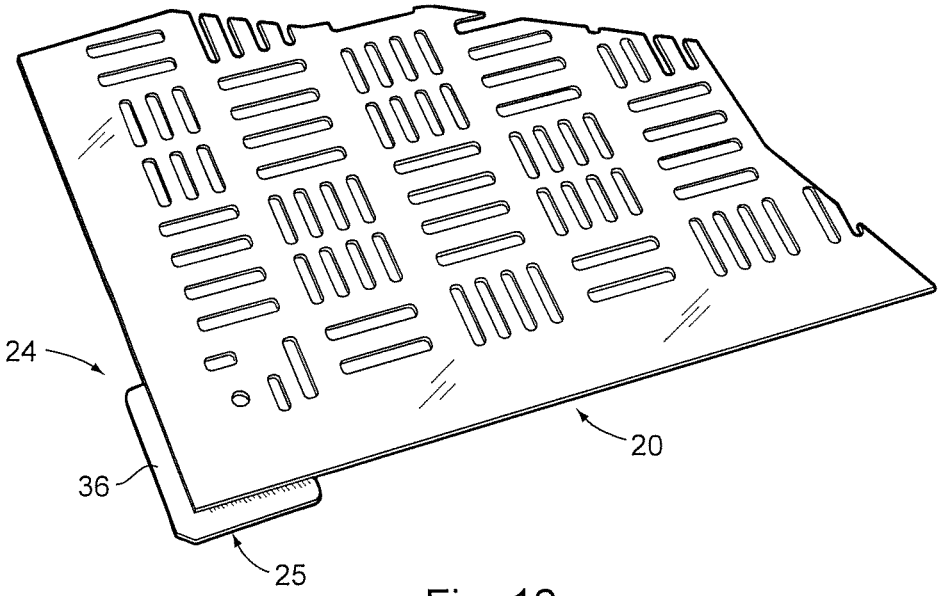
FIG. 12 is a perspective view showing a top of FIG. 11 after assembly.

The push pin retainer 51 is a stud of polymeric material that extends through and frictionally engages aligned holes 53 and 54 in the extension plate 36 and body 41 (FIG. 11). The retainer 51 allows the extension plate 36 to be attached to a body 41 ahead of installing on a panel assembly 20. The push pin retainer 51 also adds stability when the extension plate 36 and body 41 are attached to the panel assembly 20, and has been found to be useful especially when the extension plate 36 is positioned on one of the thicker pads 42 of a body 41.

Thus, the retainers 50 and 51 facilitate different assembly methods, including allowing preassembly and handling of the panel assembly 20 without losing parts and without having to perform assembly at the point of installation.

It is to be understood that variations and modifications can be made on the aforementioned structure without departing from the concepts of the present invention, and further it is to be understood that such concepts are intended to be covered by the following claims unless these claims by their language expressly state otherwise.

The embodiments of the invention in which an exclusive property or privilege is claimed are defined as follows:

1. A floor panel assembly for use in an existing raised floor system, the existing raised floor system including existing floor panels with existing support stands and existing stringers connected between the existing support stands for supporting floor panels, the floor panel assembly comprising:

a floor panel with a top structure and corner structures, each corner structure including a first retainer and down flanges that support the top structure inward from a perimeter of the top structure; and a universal quick corner at each corner structure, each universal quick corner having an extension plate attached to the first retainer and extending outboard of the down flanges at least partially toward the perimeter, and having a body with at least two thickness pads of different thickness dimensions, the universal quick corner being positionable in different positions so that a selected one of the thickness pads will support the extension plate so that the extension plate engages one or both of the associated stringer and support stand to hold an upper surface of the top structure at an adjusted height level with an upper surface of existing floor panels of the raised floor system.

2. The assembly defined in claim 1, wherein the first retainer is a post retainer.

3. The assembly defined in claim 2, including a friction retainer engaging the post retainer.

4. The assembly defined in claim 3, wherein the friction retainer is a push-on-and-twist nut.

5. The assembly defined in claim 1, wherein the body of each universal quick corner is designed to be selectively angularly oriented on the floor panel to matably engage the extension plate so that a selected one of the pads supports the extension plate at a selected height based on the different thickness of the selected pad.

6. The assembly defined in claim 1, wherein the top structure includes an apertured top plate forming an air-passing air grate.

7. The assembly defined in claim 1, wherein the extension plate includes an enlarged region abuttingly engaging all of the at least one pad.

8. The assembly defined in claim 1, wherein the body and extension plate include mating holes engaging the first retainer.

9. The assembly defined in claim 1, including a friction retainer engaging a top structure of the first retainer to hold the body and extension plate on the floor panel as a pre-assembled unit.

10. The assembly defined in claim 1, wherein the extension plate includes two outer edges that, when in an installed position, are generally vertically aligned with portions of the perimeter of the top structure at its corners.

11. A floor panel assembly for use in an existing raised floor system, the existing raised floor system including existing floor panels with existing support stands and existing stringers connected between the existing support stands for supporting floor panels, the floor panel assembly comprising:

a floor panel with a top structure and corner structures, each corner structure including a first retainer and down flanges that support the top structure inward from a perimeter of the top structure; and a universal quick corner at each corner structure, each universal quick corner having an extension plate attached to the first retainer and extending outboard of the down flanges at least partially toward the perimeter, and having a body with at least one thickness pad supporting the extension plate so that the extension plate engages one or both of the associated stringer and support stand to hold an upper surface of the top structure at an adjusted height level with an upper surface of existing floor panels of the raised floor system;

wherein the corner structure includes an apertured boss and the body includes a protruding pin for engaging the boss to hold the body on the corner structure.

12. A floor panel assembly for use in an existing raised floor system, the existing raised floor system including existing floor panels with existing support stands and existing stringers connected between the existing support stands for supporting floor panels, the floor panel assembly comprising:

a floor panel with a top structure and corner structures, each corner structure including a first retainer and down flanges that support the top structure inward from a perimeter of the top structure; and a universal quick corner at each corner structure, each universal quick corner having an extension plate attached to the first retainer and extending outboard of the down flanges at least partially toward the perimeter, and having a body with at least one thickness pad supporting the extension plate so that the extension plate engages one or both of the associated stringer and support stand to hold an upper surface of the top structure at an adjusted height level with an upper surface of existing floor panels of the raised floor system;

wherein the extension plate includes a secondary positioning hole that aligns with a mating positioning hole in the body, and including a push-pin retainer for engaging both to retain them together.

13. A method of constructing a floor panel assembly for use in an existing raised floor system, the existing raised floor system including existing floor panels and existing support stands for supporting corners of the existing floor panels, the floor panel assembly comprising steps of:

providing a floor panel with a top structure and corner structures, each corner structure including a post retainer and down flanges that support corners of the top structure inward from a perimeter of the top structure; and attaching a universal quick corner to each corner structure, the quick corners each having an extension plate and a body with at least two thickness pads of different thickness dimensions, the step of attaching including positioning the body on the associated corner structure of the floor panel so that a selected one of the two thickness pads engages the extension plate which in turn engages an associated portion of the existing raised floor system to hold an upper surface of the top structure at a height level with an upper surface of the existing floor panels of the existing raised floor system.

14. The method defined in claim 13, including a step of providing an extension plate, and wherein the step of attaching the universal quick corner includes engaging the extension plate with the thickness pad of the body.

15. In a floor panel assembly for use in an existing raised floor system, where the existing raised floor system includes existing floor panels and existing support stands and existing stringers connected between the existing support stands for supporting the existing floor panels, an improvement in the floor panel assembly comprising:

a floor panel with a top structure and corner structures, each corner structure including a post retainer and interconnected down flanges that support corners of the top structure inward from a perimeter of the top structure; and a universal quick corner at each corner structure, the universal quick corner having a body with at least two different thickness pads, the body characteristically not having threads for height adjustment but being selectively orientable on an associated one of the corner structures to position a selected one of the at least two different thickness pads to engage and support the floor panel on an associated portion of the existing support stand and stringer, thus holding an upper surface of the top structure at an adjusted height level with an upper surface of existing floor panels on the existing raised floor system.

16. The improvement of claim 15, including an extension plate engaging and supporting the body.

17. A method of assembly in an existing raised floor system, where the existing raised floor system includes existing floor panels and existing support stands and existing stringers connected between the existing support stands for supporting the existing floor panels, the method comprising steps of:

providing a floor panel with a top structure and corner structures, each corner structure including a post retainer and interconnected down flanges that support corners of the top structure inward from a perimeter of the top structure;

providing a universal quick corner at each corner structure, the universal quick corner having a body that characteristically does not have adjustment threads for height adjustment but that includes at least two different thickness pads defining different thickness dimensions; and selectively orienting the body on an associated one of the corner structures to position a selected one of the at least two different thickness pads to engage an associated portion of the existing support stand and stringer, thus holding an upper surface of the top structure at an adjusted height level with an upper surface of existing floor panels in the existing raised floor system.

18. The method defined in claim 17, including a step of providing the extension plate, and wherein the step of attaching the universal quick corner includes engaging the extension plate with the at least one thickness pad of the body.

19. A floor panel assembly, comprising:

a floor panel with corner structures extending inward from a perimeter of the floor panel; and a universal quick corner having a unitary body with a plurality of different thickness pads with non-coplanar horizontal surfaces that define different height dimensions and that are located on different parts of the body, the universal quick corner characteristically not having adjustment threads for providing height adjustment but being positionable in different orientations so that a selected one of the thickness pads will support the floor panel on adjacent floor support stands and stringers, so that a top surface of the floor panel is at an adjusted height that is level with an upper surface of adjacent floor panels that are also supported by the adjacent floor support stands and stringers in a raised floor system.

20. The floor panel assembly defined in claim 19, wherein the plurality of different thickness pads includes at least three different thickness pads.

21. The floor panel assembly defined in claim 20, wherein the plurality of different thickness pads includes at least four different thickness pads.

* * * * *